US009413054B2

(12) United States Patent
Hash

(10) Patent No.: US 9,413,054 B2
(45) Date of Patent: Aug. 9, 2016

(54) MINIATURE WIDEBAND QUADRATURE HYBRID

(71) Applicant: HARRIS CORPORATION, Melbourne, FL (US)

(72) Inventor: Ronald J. Hash, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 28 days.

(21) Appl. No.: 14/565,908

(22) Filed: Dec. 10, 2014

(65) Prior Publication Data

US 2016/0172736 A1 Jun. 16, 2016

(51) Int. Cl.
*H01P 5/18* (2006.01)
*H01P 3/08* (2006.01)

(52) U.S. Cl.
CPC ..... *H01P 5/184* (2013.01)

(58) Field of Classification Search
CPC ..... H01P 5/18; H01P 3/08
USPC ..... 333/109, 110, 111, 112, 116
See application file for complete search history.

(56) References Cited

U.S. PATENT DOCUMENTS 3,601,716 A * 8/1971 Bolt ..... H01P 5/185 333/116
4,216,446 A * 8/1980 Iwer ..... H01P 5/185 333/116
5,424,694 A * 6/1995 Maloratsky ..... H01P 5/185 333/112
5,625,328 A * 4/1997 Coleman, Jr. ..... H01P 5/185 333/116
6,759,922 B2 * 7/2004 Adar ..... H03F 3/602 333/116
6,972,638 B2 * 12/2005 Usami ..... H01P 5/185 333/109
7,671,699 B2 * 3/2010 Wren ..... H01P 5/184 333/109
7,714,679 B2 * 5/2010 Jiang ..... H01P 5/185 333/116
7,741,929 B2 6/2010 Hash
8,558,640 B2 * 10/2013 Hirai ..... H01P 5/185 333/111
9,240,623 B2 * 1/2016 Wang ..... H01P 5/187

* cited by examiner

*Primary Examiner* — Dean Takaoka

(74) *Attorney, Agent, or Firm* — Fox Rothschild LLP; Robert J. Sacco; Carol E. Forsyth-Thorstad

(57) ABSTRACT

Directional coupler includes a first, second and third transmission lines. Each of the first and second transmission line elements is disposed on a dielectric substrate, and has a first end and a second end. At least a portion of the first and second transmission line elements are adjacent along a path. A third transmission line element is disposed along the path between the first and the second transmission line elements and separated therefrom by a portion of the dielectric substrate. The third transmission line element is electrically connected to a ground plane disposed on a surface of the dielectric substrate opposed from the first and second transmission line elements.

19 Claims, 8 Drawing Sheets

MINIATURE WIDEBAND QUADRATURE HYBRID

BACKGROUND OF THE INVENTION

1. Statement of the Technical Field

The present invention is directed to the field of directional couplers, and more particularly, to directional couplers having a miniaturized design.

2. Description of the Related Art

Directional couplers are four-port circuits typically used for sampling of the input power for use in signal monitoring circuits. The sampled signal is typically measured to determine the power level, frequency, and/or signal shape (modulation) of the input signal. One typical directional coupler configuration is referred to as a hybrid coupler, a 3 dB coupler, a 3 dB hybrid coupler, a quadrature coupler, or a quadrature hybrid coupler, amongst other names. Regardless of how it is referred to, the quadrature hybrid coupler generally has the characteristics of dividing the input signal into two signals having equal powers and separated in phase by 90 degrees when the four ports are properly terminated.

Quadrature hybrid couplers are commonly implemented by using two edge coupled transmission lines. However, there are design challenges which arise when implementing quadrature hybrid couplers using planar circuit fabrication technologies, such as integrated circuit technologies, stripline technologies, and printed circuit board technologies. U.S. Pat. No. 7,741,929 to Hash discloses one type of miniature hybrid coupler which seeks to overcome some of these design challenges.

The design problems associated with implementing quadrature hybrid couplers using planar circuit fabrication technologies are compounded when wideband performance is a design goal. The reason for this generally relates to the need for additional coupler sections when implementing wideband coupler designs. The additional sections typically each have an electrical length of ¼ wavelength and therefore occupy a significant amount of space on a substrate. Moreover, the additional sections generally need to provide a relatively low amount of coupling. Low coupling is not conducive to compact layouts since it usually involves transmission lines traces having a relatively wide physical width and a relatively large space between coupled lines. Consequently, it has not been practical to implement wideband hybrid couplers in RF integrated circuits, except at millimeter wave. Instead, wideband hybrid couplers have been implemented using surface mount technology (SMT) components. These types of hybrid couplers can provide satisfactory performance, but are prohibitively large for many applications and cannot be practically implemented on RFICs.

SUMMARY OF THE INVENTION

The invention concerns a radio frequency directional coupler which includes a first, second and third transmission line element. Each of the first and second transmission line elements is disposed on a dielectric substrate, and has a first end and a second end. The first and the second transmission line elements disposed on common plane and at least a portion of the first and second transmission line elements are adjacent along a path. At least a third transmission line element extends substantially coextensive with a length of said first and second transmission line elements. At least the third transmission line element is disposed along the path between the first and the second transmission line elements and separated therefrom by a portion of the dielectric substrate. The third transmission line element is electrically connected to a ground plane disposed on a surface of the dielectric substrate opposed from the first and second transmission line elements.

The invention also concerns a wideband radio frequency directional coupler which includes three coupler sections. A first and second coupler section each include a first, second and third transmission line arranged as previously described. The first coupler section and the second coupler section are electrically connected by a third coupler section. The third coupler section includes a fourth transmission line element having a first end and a second end and a fifth transmission line element having a first end and a second end. The fourth and fifth transmission line elements are disposed on the common plane, and at least a portion of the fourth and fifth transmission line elements are disposed adjacent along a second path. A first series of conductive coupling elements is disposed along the second path in a second plane parallel to the first plane and separated from the first plane by a predetermined distance to increase a capacitive coupling between the fourth and fifth transmission line elements.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

Figure 1:
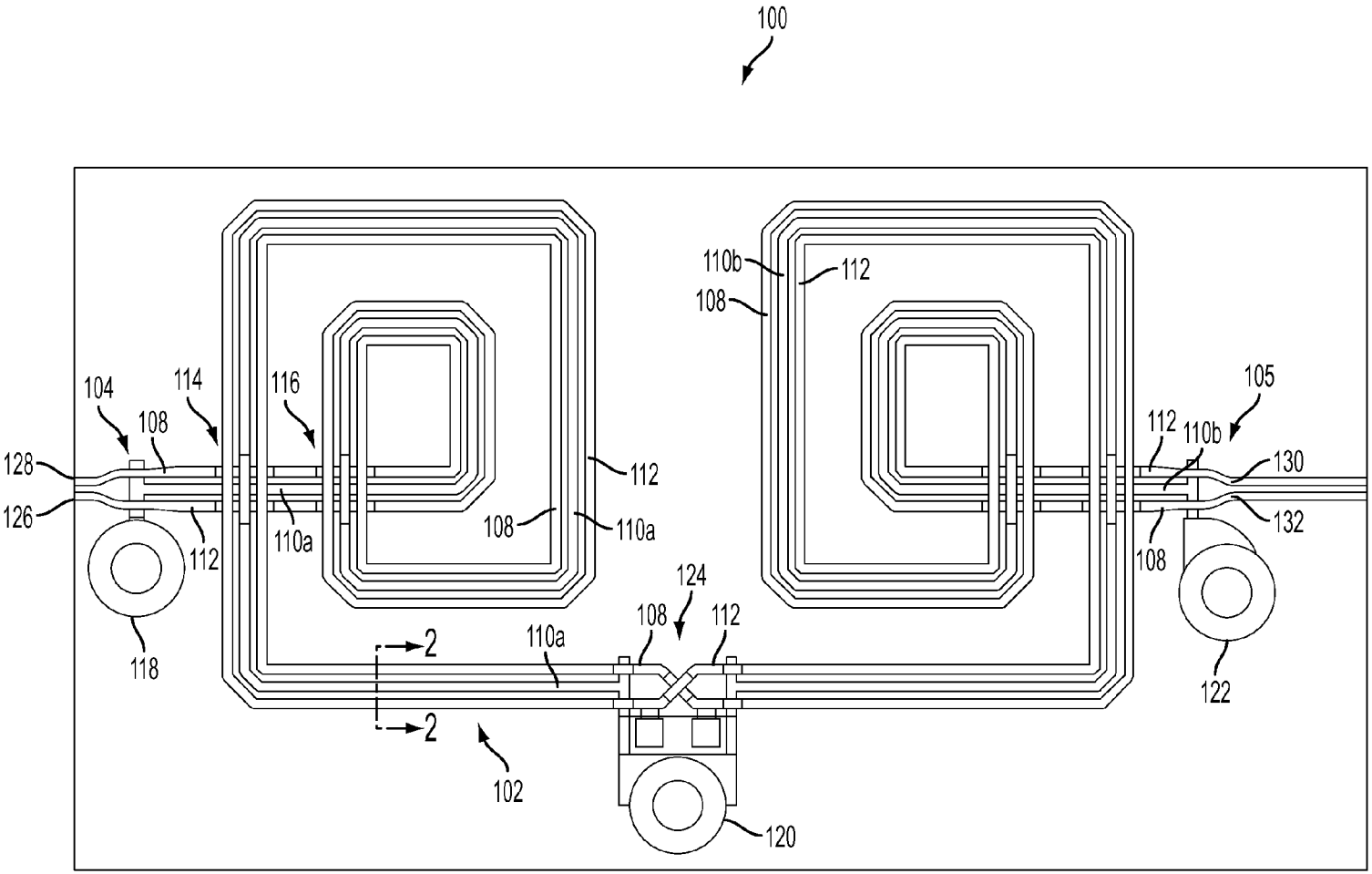
FIG. 1 is a top view of a radio frequency directional coupler.
Figure 2:
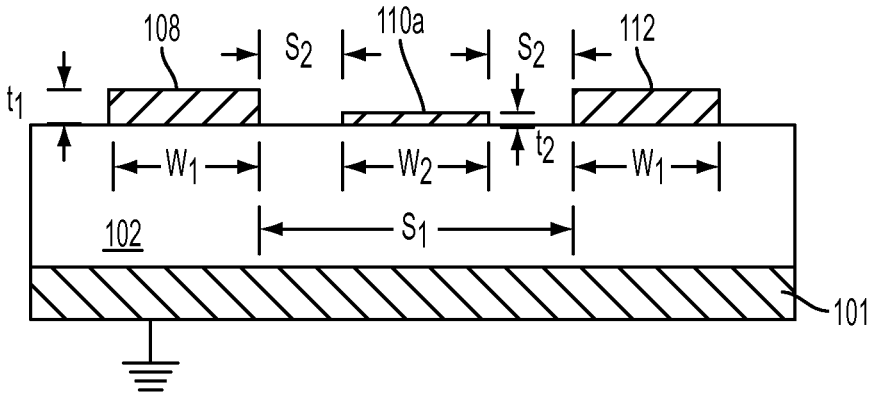
FIG. 2 is a cross-sectional view of the directional coupler in FIG. 1, taken along line 2-2.

There is shown in FIGS. 1 and 2 a radio frequency directional coupler section 100. The coupler section can be used alone or in combination with other coupler sections as hereinafter described. The basic operating principle of coupler section 100 is similar to that of a conventional hybrid coupler. Radio frequency energy applied to an input port (e.g. port 126) is communicated to an output port (e.g. port 130). A portion of the RF energy is also coupled from the input port (e.g. port 126) to a coupled port 128. A terminated port (e.g. port 132) is terminated in an impedance that preferably matches the characteristic impedance of the device. A cross-over 124 flips the position of the transmission lines. Consequently output port 130 is directly coupled to the input port 126, port 132 is a terminated (or isolated) port, and 128 is the coupled port.

The coupler section 100 includes a transmission line 108. The transmission line is comprised of a conductive trace having a predetermined width $W_1$, which is disposed on a dielectric substrate 102. The dielectric substrate 102 can be formed of one or more layers of dielectric material disposed on a ground plane 101. The transmission line has a first end at ground junction 104 and a second end at ground junction 105. A transmission line 112 is also formed of a conductive trace which has a width $W_1$. The transmission line 112 is disposed on the dielectric substrate, and has a first end at ground junction 104 and a second end at ground junction 105. The transmission lines 108, 112 are disposed on a planar surface defined by the dielectric substrate and it can be observed in FIG. 1 that at least a portion of the transmission lines are adjacent along a path. As shown in FIG. 2, the transmission lines are separated by a distance $S_1$ and have an electrical length that is substantially equal.

A pair of transmission lines 110*a*, 110*b* are each also comprised of a conductive trace and each has a width $W_2$, which can be the same or different as compared to $W_1$. The transmission lines 110*a*, 110*b* are disposed along the path between the transmission lines 108, 112 and are separated from transmission lines 108, 112 by a portion of the dielectric substrate. As shown in FIG. 2, the transmission line 110*a* is spaced apart from each of the transmission lines 108, 112 by a distance $S_2$. Transmission line 110*b* is advantageously spaced apart from each of the transmission lines 108, 112 by the same distance. A conductive ground plane 101 is disposed on a surface of the dielectric substrate 102 opposed from the surface on which the transmission lines 108, 110*a*, 110*b*, and 112 are disposed. Notably, the transmission lines 110*a*, 110*b* are each electrically connected to the ground plane 101 at one or more locations along its length. For example, ground connections for transmission line 110*a* can be provided at ground junctions 104 and at crossover 124. Ground connections for transmission line 110*b* are provided at ground junctions 105 and at crossover 124.

Figure 6:
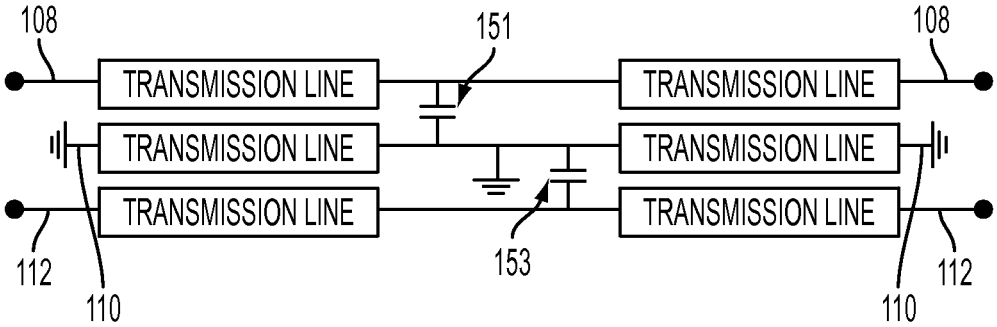
FIG. 6 is a simplified schematic drawing which is useful for understanding an alternative embodiment of the radio frequency directional coupler in FIG. 1.

An embodiment of the invention is described herein as having two separate transmission lines 110*a*, 110*b*, with each line terminating at cross-over 124. Such an arrangement can be convenient when transmission lines 108, 112 are arranged in a rectangular spiral configuration with a cross-over 124. In such a scenario, the gap between transmission lines 110*a*, 110*b* is a minor discontinuity and has little effect on the performance of the coupler. Accordingly, the transmission lines 110*a*, 110*b* together effectively function as a single continuous transmission line that is substantially coextensive with the first and second transmission lines. The word substantially is used here to clarify that there will exist in this scenario a small discontinuity as between the two transmission lines at the location of the cross-over. Still, it should be understood that the invention is not limited in this regard and in some embodiments (e.g., where a cross-over 124 is absent), a single continuous transmission line 110 can be used instead of two separate transmission lines 110*a*, 110*b*. In such a scenario, the single transmission line will be coextensive in length with transmission lines 108, 112. A ground connection can be provided for the transmission line 110 at mid-length or at some other suitable location(s) along the line. A simplified schematic representation of the coupler section 100 shown with a single continuous transmission line 110 is shown in FIG. 6.

Adjacent portions of the transmission lines 108 and 112 are configured to each have a pre-defined electrical length which is substantially equal. For example, in an embodiment of the invention the electrical length of each of these transmission lines is designed so that they are approximately equal to ¼ of a wavelength of an input RF signal for which the coupler section has been designed. In other words, the overall electrical length of transmission lines 108 and 112, extending from ground junction 104 to ground junction 105, is approximately ¼ wavelength. Transmission lines 110*a*, 110*b* are in combination substantially coextensive with the lengths of transmission lines 108 and 112. However, each of transmission lines 110*a*, 110*b* respectively terminates and is connected to ground at crossover 124. Accordingly, transmission lines 110*a*, 110*b* are individually only half as long as transmission lines 108, 112. More particularly, transmission lines 110*a*, 110*b* are each individually only approximately ⅛ of a wavelength in length in an embodiment of the invention. It will be appreciated that the invention is not limited to the foregoing transmission line lengths and other electrical lengths are also possible. As may be observed in FIGS. 1 and 4, a width of the transmission lines 108, 110*a*, 110*b*, 112 remains substantially unchanged at each point along the length of the pre-defined electrical length in the embodiment shown. Still, the invention is not limited in this regard, and discontinuities may be present in one or more of the transmission lines in some scenarios.

The transmission lines 110*a*, 110*b* load the transmission lines 108, 112 so as to cause them to have a width that is more narrow for a given characteristic impedance than would otherwise be possible in the absence of transmission lines 110*a*, 110*b*. Consequently, the presence of the transmission lines 110*a*, 110*b* facilitates a more narrow width of the transmission lines 108, 112, than would otherwise be possible for a coupler in which the transmission lines 110*a*, 110*b* are not present. This reduction in line width facilitates a coupler section 100 which can be made relatively smaller in size. Also, the transmission lines 110*a*, 110*b* function to reduce a coupling between the transmission lines 108, 112. This reduction in coupling is advantageous when implementing coupler sections where only a minimal amount of coupling is desired between the transmission lines 108, 112. The reduction in line width and reduction in coupling can be particularly useful in certain multi-section coupler applications which shall be described in more detail below.

Those skilled in the art will appreciate that the actual characteristic impedance value of lines 108, 112 and the amount of coupling between the two transmission lines will vary as a function of changes in the specific device geometry (e.g. will vary with changes in W1, W2, S1 and S2). The amount of coupling obtained is a very complex interaction which can be determined for specific geometries by using conventional electromagnetic analysis tools. Suitable electromagnetic analysis tools include commercially available software applications which are well known in the art. Accordingly, these tools will not be described here in detail. However, it will be appreciated that specific performance characteristics for a directional coupler can be obtained by utilizing such electromagnetic analysis tools. For example, an iterative approach can involve varying one or more values of W1, W2, S1, and S2 until a predefined set of performance criteria has been satisfied. Still, there are some generalities concerning the directional coupler described herein which should be noted. For example, increasing W1 while holding W2, S1, and S2 constant lowers the characteristic impedance of 108 and 112. Increasing W2 also lowers the impedance of 108 and 112 but also decreases the coupling between 108 and 112. Increasing S1 or S2 lowers both the impedance of 108 and 112 and the coupling.

Figure 3:
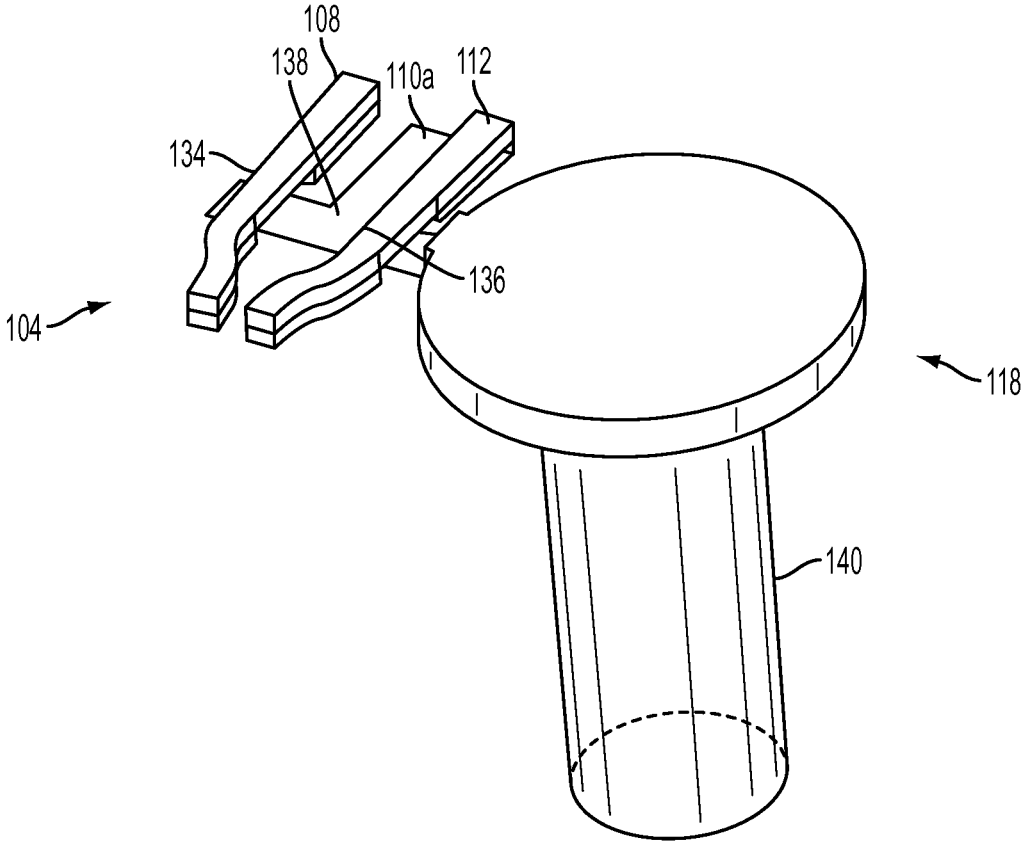
FIG. 3 is an enlarged perspective view of a ground junction portion of the directional coupler in FIG. 1.
Figure 4:
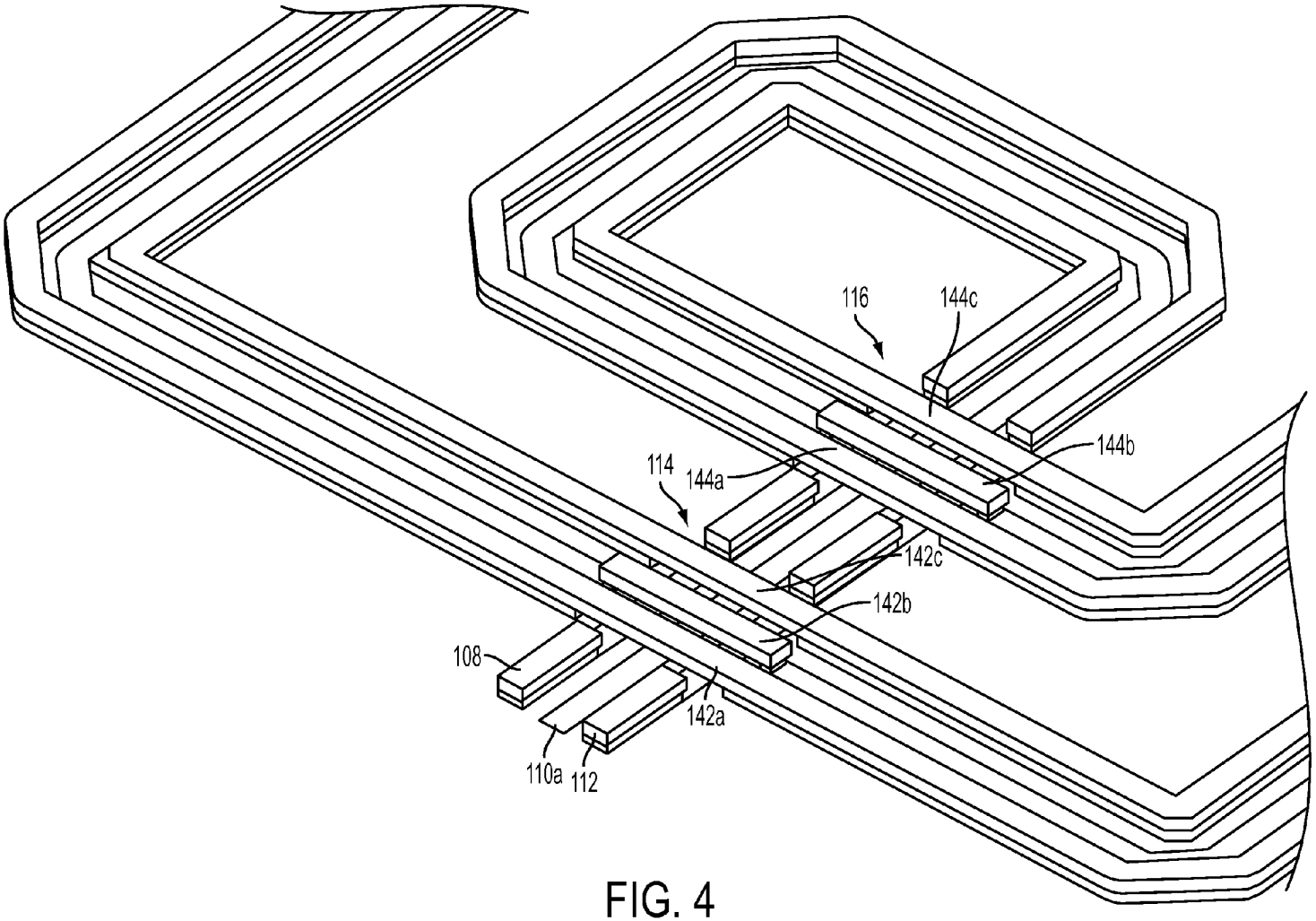
FIG. 4 is a perspective view of a portion of the directional coupler in FIG. 1, enlarged to show detail.

A thickness $t_1$ of the transmission lines 108, 112 can be the same or different as compared to the thickness $t_2$ of transmission lines 110*a*, 110*b*. For example, there is shown in FIGS. 2-4 an embodiment in which the transmission lines 108, 112 have a greater thickness as compared to the transmission lines 110*a*, 110*b*. Such an arrangement can be advantageous under certain circumstances. For example, transmission line thickness has an influence upon the coupling between the transmission lines and loss which occurs as RF signals are communicated through the structure. The arrangement shown in FIG. 3 has the advantage of providing a high degree of compactness while maintaining low loss. Similar performance can be achieved with the transmission lines 108, 110*a*, 110*b*, 112 all having the same thickness but with increased separation between the lines. Still, it will be understood that such an arrangement would increase the overall size of the coupler section 100 with no performance advantage.

Referring now to FIG. 3 there is shown a view of ground junction 104 which is enlarged to show detail. The ground junction includes a conductive cross-bar 138 disposed on the dielectric substrate. The cross-bar extends beneath bridge sections 134, 136 of the transmission lines 108, 112. The bridge sections 134, 136 form a conductive bridge which extends over the cross-bar 138. The bridge sections are isolated from the cross-bar 138 by a suitable dielectric material, such as air. The cross-bar provides an electrical connection between the transmission line 110*a* and ground lug 118. The via 140 forms an electrical connection between the ground lug 118 and ground plane 101. Ground junction 105 has a similar structure to that of ground junction 104. Accordingly, the description of ground junction 104 is sufficient for understanding the arrangement of ground junction 105.

The transmission lines 108, 110*a*, 110*b*, 112 can extend along a straight or linear path. However, in order to provide a compact implementation of the coupler section 101, it is advantageous for the transmission lines to be disposed along a spiral, serpentine, or meandering path. Such an arrangement is shown in FIGS. 1 and 4, wherein the transmission lines 108, 110*a*, 110*b* 112 are disposed along a path which defines a rectangular spiral. As shown in FIG. 4, the rectangular spiral formed by transmission lines 108, 110*a*, 110*b* can include a plurality of conductive bridge sections 142*a*, 142*b*, 142*c*, 144*a*, 144*b*, 144*c* at locations 114, 116 where the transmission lines traverse one another. At such locations, the conductive bridge sections extend over the transmission lines 108, 110*a*, 112 which are being traversed. Each conductive bridge section is isolated from the transmission lines which are being traversed by a space which can be occupied by a dielectric material such as air. A similar arrangement is provided at each location where transmission lines 108, 110*b*, 112 traverse one another.

Figure 5:
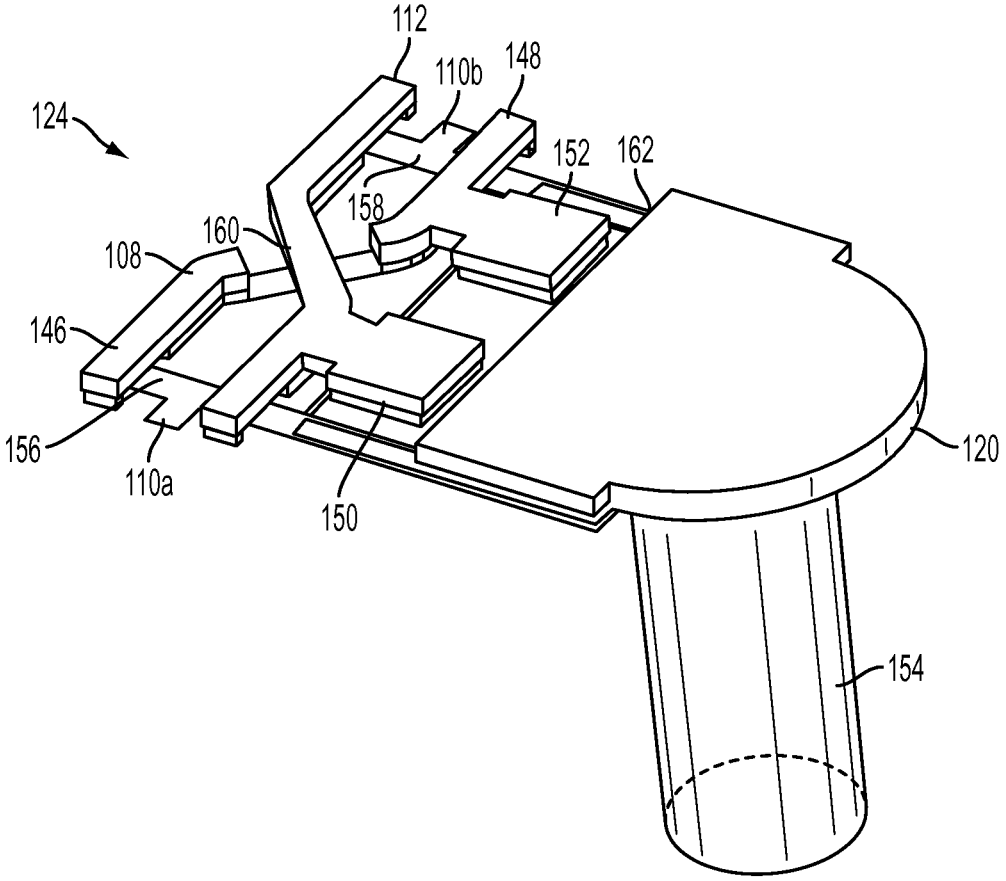
FIG. 5 is an enlarged perspective view of a cross-over portion of the directional coupler in FIG. 1.

In embodiments in which the transmission lines follow a spiral path (e.g. a rectangular spiral), it can be advantageous for the transmission lines 108, 112 to cross at the mid-point of the predetermined electrical length defining the adjacent sections. Such an arrangement can ensure that the electrical length of the transmission lines is equal despite having followed a non-linear path. Accordingly, there is shown in FIGS. 1 and 5 that the coupler section 100 can include a cross-over 124 to facilitate the equalization of the electrical length of the transmission lines 108, 112. The cross-over can include a conductive bridge section 160 where the transmission line 112 traverses transmission line 108 as shown. The bridge section 160 extends above and is isolated from transmission line 108 by a suitable dielectric material such as air. Additional ground connections are also provided for the transmission line 110*a*, 110*b* at the cross-over 124. Accordingly, it can be observed in FIG. 5 that conductive cross-bars 156, 158 connect transmission lines 110*a*, 110*b* to ground lug 120. Ground lug 120 is connected to ground plane 101 through via 154.

The inclusion of the transmission line 110*a*, 110*b* as described herein advantageously facilitates narrower line widths for a given impedance and provides for a reduced coupling between the transmission lines 108, 112. However, a further adjustment of the characteristic impedance of the transmission lines 108, 112 may sometimes be necessary. Accordingly, some embodiments of the present invention provide additional discrete reactive elements in the inventive coupler section to allow adjustment of the characteristic transmission line impedance. In these embodiments, the discrete reactive elements can be connected to the transmission lines 108, 112 at one or more selected locations along their length to adjust the total impedance of the inventive coupler section.

For example, as shown in FIG. 6, a coupler section 100 can include shunt capacitors 151, 153 at a location which is at half of the predetermined electrical length of the transmission lines 108, 112. In the scenario where the transmission lines 108, 112 are ¼ wavelength in electrical length, these shunt capacitors would be located at ⅛ of a wavelength. In the embodiment shown in FIGS. 1 and 5 shunt capacitors are coupled to the transmission lines 108, 112 at cross-over 124. The shunt capacitors are comprised of plate members 150, 152, which are spaced apart from a conductive face 162 of ground lug 120 by a small gap to define a capacitance. A thin film dielectric material is advantageously disposed within the gap and supports the plate members. However, the invention is not limited in this regard and other periodic arrangements of discrete reactive components can be used. Depending upon the particular design requirements, these discrete reactive components can be varied with regard to their number and with respect to the type of discrete reactive elements used for the components. The values of the discrete reactive components and their associated geometry can be determined using conventional electromagnetic analysis tools and methods similar to those described above.

As a consequence of the inclusion of discrete reactive elements, the inventive coupler section can be further reduced in size. For example, shunt capacitors, as described above, decrease the even mode impedance of the structure which in turn decreases coupling. In the various embodiments of the present invention, the final dimensions of the inventive coupler, including the dimensions of the transmission lines 108, 110*a*, 110*b*, 112, the spacing between each line, and the size, number, and types of discrete reactive elements can vary according to the impedance requirements and/or the operating frequency needed for the inventive coupler.

A coupler section 100 as described herein can be particularly useful in the design of a wideband compact multi-section hybrid coupler. U.S. Pat. No. 7,741,929 to Hash disclosed a miniature quadrature hybrid RF direction coupler suitable for operation over about an octave of bandwidth. However, the implementation of a wideband hybrid coupler that is suitable for operation over more than one octave requires multiple additional coupler sections, each of which is conventionally ¼ of a wavelength long. These additional coupler sections must have low coupling as opposed to the high coupling disclosed in the '929 patent. However, the requirement for low coupling creates certain challenges as hybrid coupler devices which have low coupling are not conducive to compact layouts. Such devices typically require transmission line conductive traces that are physically wide and have large spaces between the coupled transmission lines. Consequently, wideband hybrid couplers have no practical implementation in RF integrated circuits, except at millimeter wave frequencies. However, the coupler section 100, provides low coupling in a very compact implementation. Accordingly, when coupler section 100 is used in conjunction with the coupler section described in the '929 patent, a compact design can be provided for a wideband coupler. In fact, the design can be sufficiently small in size so as to be suited for implementation on an RF integrated circuit (RFIC) or monolithic microwave integrated circuit (MMIC).

Figure 7:
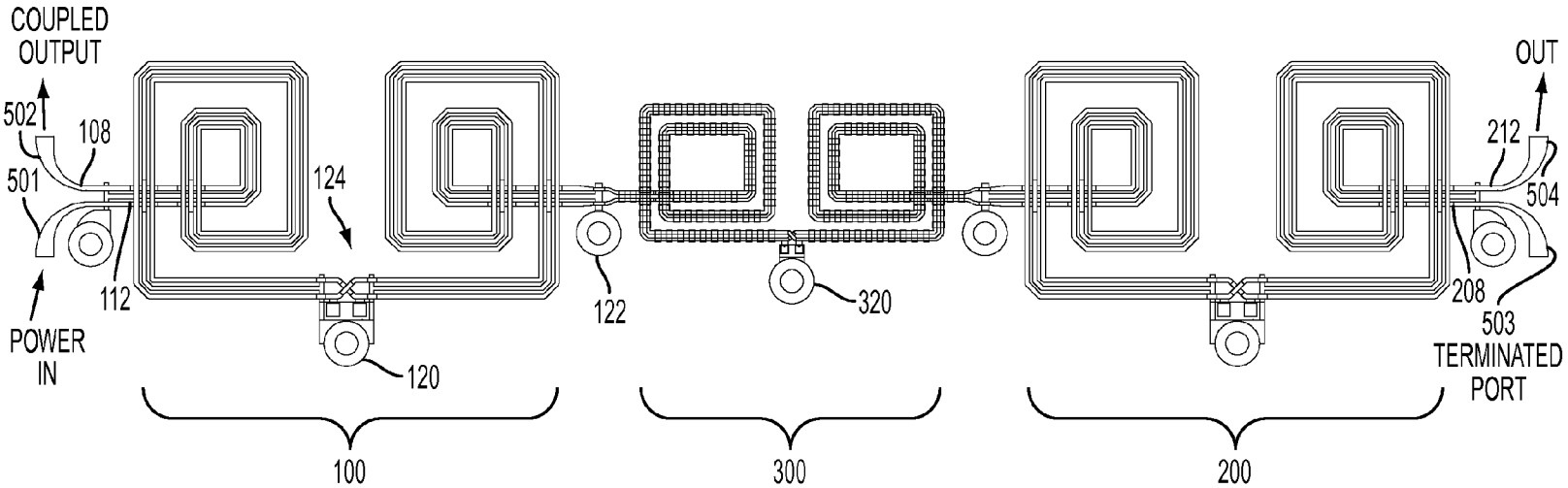
FIG. 7 is a top view of a wideband multi-section radio frequency directional coupler.

Referring now to FIG. 7 there is shown a wideband radio frequency directional coupler 700 which is comprised of coupler sections 100, 200, and 300. Each coupler section extends along a predefined path which can be linear, meandering, serpentine, spiral or rectangular spiral as shown. Coupler section 200 comprises an arrangement similar to that of coupler section 100. Accordingly, the foregoing description of coupler section 100 is sufficient for understanding coupler section 200. Coupler section 200 includes transmission lines which are arranged in a manner similar to transmission lines 108, 110*a*, 110*b*, 112 of coupler section 100.

Figure 8:
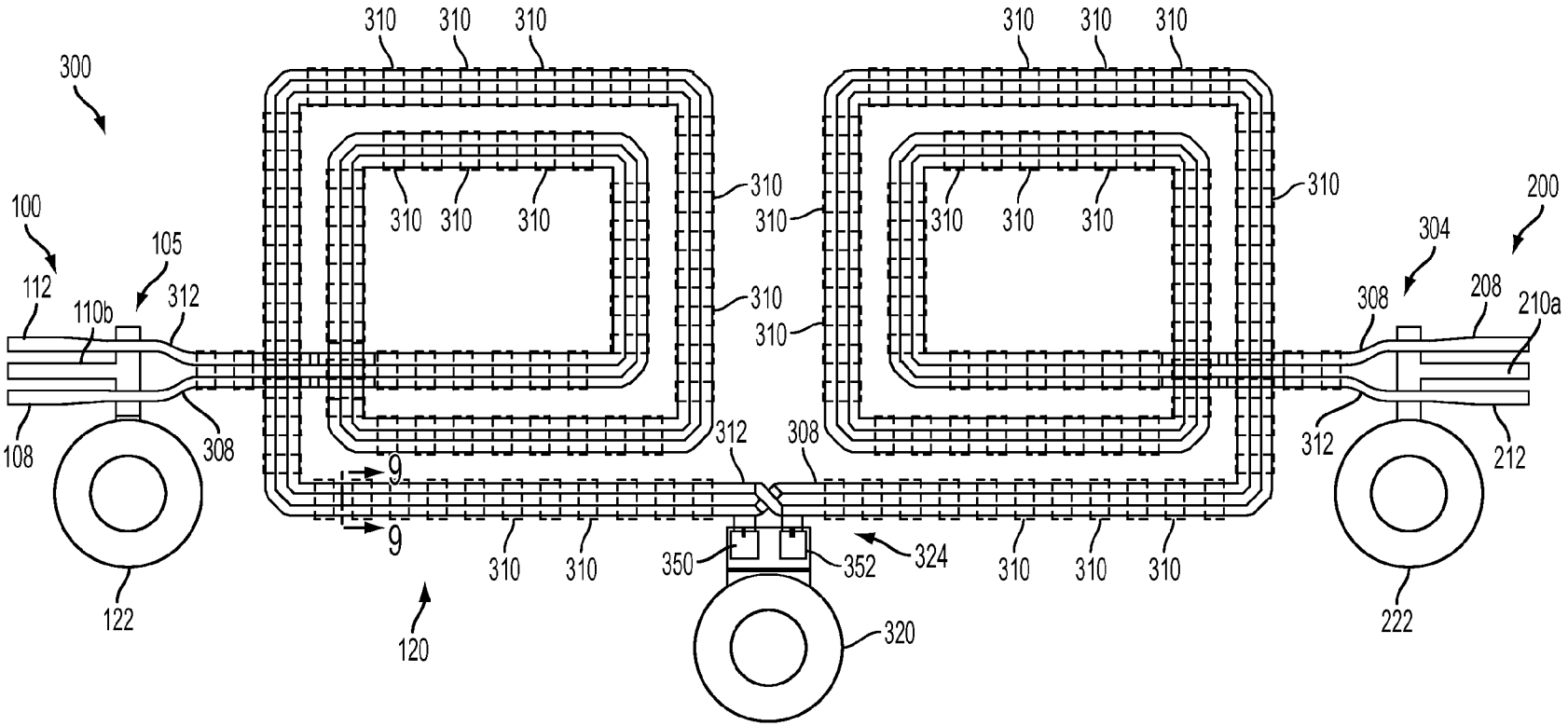
FIG. 8 is a top view of a center section of the coupler in FIG. 7.

The coupler section 300 is electrically connected to the coupler sections 100, 200. Coupler section 300 includes transmission lines 308, 312. As shown in FIG. 8, transmission lines 308, 312 are connected at a first end thereof to end portions of transmission line sections 108, 112. Similarly, the transmission lines 308, 312 are connected at a second opposing end to transmission lines 208, 212 of coupler section 200. Also shown in FIG. 8 are features associated with a ground junction 304. Ground junction 304 has a structure that is similar to ground junction 104 as shown in FIG. 3. Transmission line 210*a* associated with coupler section 200 is coupled to ground at ground junction 304 through ground lug 222 in a manner similar to that previously described with regard to ground junction 104.

Figure 9:
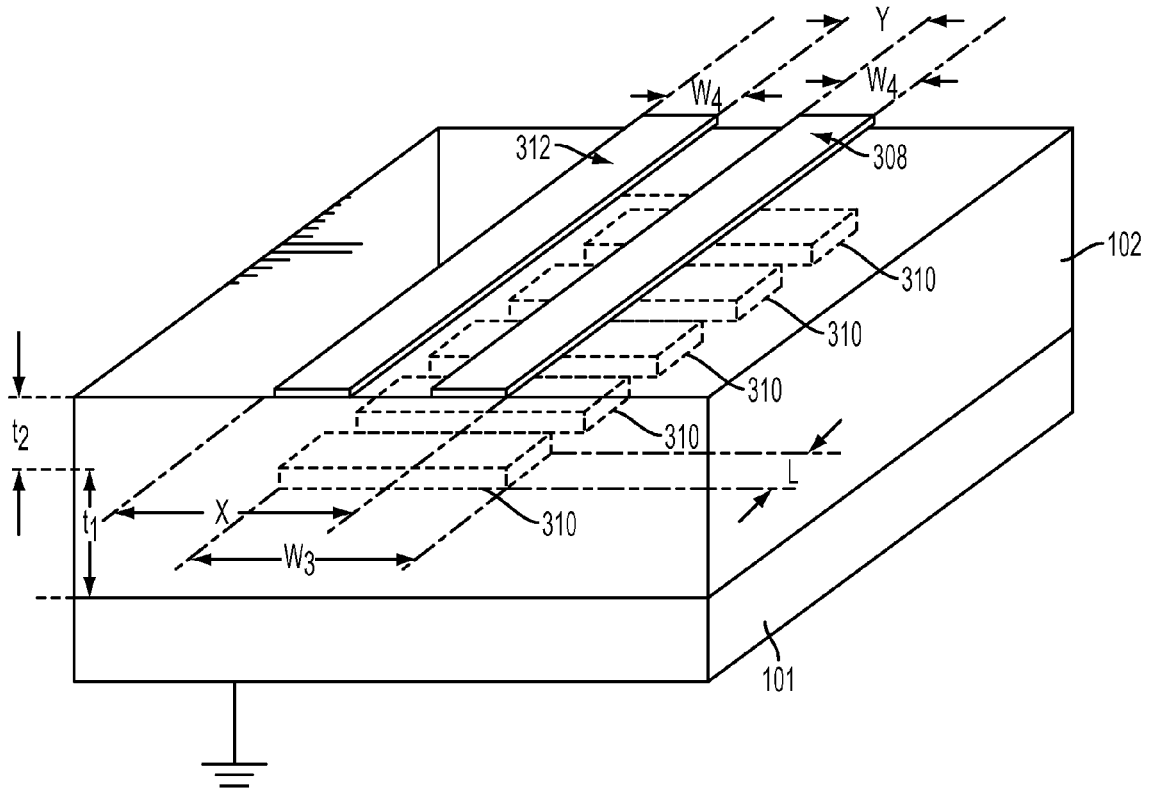
FIG. 9 is a perspective view showing a cross-section of the coupler in FIG. 7, taken along line 9-9.

Coupler section 300 is a miniature quadrature hybrid RF direction coupler having an arrangement similar to that disclosed in U.S. Pat. No. 7,741,929 to Hash. The coupler section includes coupling elements 310 which are formed of a conductive material. The coupling elements are disposed at a location spaced above or below the length of the transmission lines 308, 312. For example, as shown in FIG. 9, the coupling elements can be disposed a distance $t_2$ below the transmission lines 308, 312 and can be spaced a distance $t_1$ above the ground plane 101. The coupling elements have a width $W_3$ and a length L. A coupler section 300 as described herein will provide a relatively high degree of capacitive coupling between transmission lines 308, 312 while facilitating transmission line widths $W_4$ and spacing Y that can be reliably mass produced in semi-conductor and thin film circuit photolithography. As such, the overall width X of the combined transmission lines and spacing between such lines is substantially reduced as compared to a scenario in which the coupling elements 310 are not included. The overall length of transmission lines 308, 312 can be λ/4 or less, further facilitating the goal of miniaturization as explained in the '929 patent.

Coupler section 300 optionally includes one or more discrete reactive elements connected to the transmission lines along their length. For example, FIG. 8 shows that capacitors 350, 352 can be connected to transmission lines 308, 312 and coupled to ground through a dielectric film to ground lug 320. Ground lug 320 is connected to ground plane 101 by way of a conductive via (not shown). Discrete reactive elements such as capacitors 350, 352 are useful to facilitate adjustment of the total impedance of the inventive coupler. Additional details relating to the design of coupler section 300 will not be reproduced here as a full description of such coupler section has been provided in the specification of the '929 patent, the disclosure of which is expressly incorporated herein by reference.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

I claim:

1. A radio frequency directional coupler comprising:

a first transmission line element disposed on a dielectric substrate, and having a first end and a second end;

a second transmission line element disposed on said dielectric substrate, and having a first end and a second end, said first and said second transmission line elements disposed on a first plane, and at least a portion of said first and second transmission line elements are adjacent along a path;

at least a third transmission line element which extends substantially coextensive with a length of said first and second transmission line elements, at least said third transmission line element disposed along said path between said first and said second transmission line elements and separated therefrom by a portion of said dielectric substrate, said third transmission line element electrically connected at a plurality of distributed locations along its length directly to a ground plane disposed on a surface of said dielectric substrate opposed from said first and second transmission line elements; and wherein said radio frequency directional coupler is configured to couple signals from the first transmission line element to the second transmission line element, and said at least one third transmission line element is configured to reduce an amount of coupling between the first and second transmission line.

2. The radio frequency directional coupler according to claim 1, wherein said adjacent portions of said first and second transmission lines are configured to have a pre-defined electrical length approximately equal to ¼ of a wavelength of an input RF signal.

3. The radio frequency directional coupler according to claim 1, wherein a width of said third transmission line is substantially equal at each point along said third transmission line element disposed along said path.

4. The radio frequency directional coupler according to claim 1, wherein said third transmission line element facilitates a desired characteristic impedance of said first and second transmission line elements while maintaining at least a minimum predetermined line width of said first and second transmission lines.

5. The radio frequency directional coupler according to claim 1, wherein a thickness of said first and second transmission line elements is greater as compared to a thickness of said third transmission line element.

6. The radio frequency directional coupler according to claim 1, further comprising one or more discrete reactive elements coupled to said first and second transmission line elements.

7. The radio frequency directional coupler according to claim 1, wherein said third transmission line element is disposed on said first plane.

8. The radio frequency directional coupler according to claim 1, wherein said first and second transmission line elements have substantially equal length dimensions.

9. A radio frequency directional coupler comprising:

a first transmission line element disposed on a dielectric substrate, and having a first end and a second end;

a second transmission line element disposed on said dielectric substrate, and having a first end and a second end, said first and said second transmission line elements disposed on a first plane, and at least a portion of said first and second transmission line elements are adjacent along a path; and at least a third transmission line element which extends substantially coextensive with a length of said first and second transmission line elements, at least said third transmission line element disposed along said path between said first and said second transmission line elements and separated therefrom by a portion of said dielectric substrate, said third transmission line element electrically connected to a ground plane disposed on a surface of said dielectric substrate opposed from said first and second transmission line elements;

wherein said first transmission line element, said second transmission line element, and at least said third transmission line element define a first coupler section and wherein said radio frequency directional coupler further comprises a second coupler section and a third coupler section, said second coupler section including:

a fourth transmission line element having a first end and a second end;

a fifth transmission line element having a first end and a second end, said fourth and said fifth transmission line elements disposed on said first plane, and at least a portion of said fourth and fifth transmission line elements are adjacent along a second path;

at least a sixth transmission line element which extends substantially coextensive with a length of said fourth and fifth transmission line elements, at least said sixth transmission line element disposed along said second path between said fourth and said fifth transmission line elements and separated therefrom by a portion of said dielectric substrate, said sixth transmission line element coupled to said ground plane; and wherein said third coupler section is electrically connected between said first and second coupler sections.

10. The radio frequency directional coupler according to claim 9, wherein said third coupler section comprises:

a seventh transmission line element having a first end and a second end;

an eighth transmission line element having a first end and a second end, said seventh and eighth transmission line elements disposed on said first plane, and at least a portion of said seventh and eighth transmission line elements disposed adjacent along a third path; and a first series of conductive coupling elements disposed along said path in a second plane parallel to said first plane and separated from said first plane by a predetermined distance to increase a capacitive coupling between said seventh and eighth transmission line elements.

11. The directional coupler according to claim 10, wherein said adjacent portions of said seventh and eighth transmission line elements are configured to have a pre-defined electrical length approximately equal to ¼ of a wavelength of said input RF signal.

12. A radio frequency directional coupler comprising:

a first coupler section and a second coupler section, electrically connected by a third coupler section, said first and second coupler sections each respectively comprising a first transmission line element having a first end and a second end;

a second transmission line element having a first end and a second end, said first and said second transmission line elements disposed in a first plane, and at least a portion of said first and second transmission line elements are adjacent along a path;

at least a third transmission line element which extends substantially coextensive with a length of said first and second transmission line elements, at least said third transmission line element disposed along said path between said first and said second transmission line elements and separated therefrom by a dielectric element, said third transmission line coupled to a ground plane; and wherein said third coupler section comprises a fourth transmission line element having a first end and a second end;

a fifth transmission line element having a first end and a second end, said fourth and fifth transmission line elements disposed on said first plane, and at least a portion of said fourth and fifth transmission line elements disposed adjacent along a second path; and a first series of conductive coupling elements disposed along said second path in a second plane parallel to said first plane and separated from said first plane by a predetermined distance to increase a capacitive coupling between said fourth and fifth transmission line elements.

13. The radio frequency directional coupler according to claim 12, wherein said adjacent portions of said first and second transmission line elements are configured to have a pre-defined electrical length approximately equal to ¼ of a wavelength of an input RF signal.

14. The radio frequency directional coupler according to claim 12, wherein a width of said third transmission line element is substantially equal at each point along said third transmission line element.

15. The radio frequency directional coupler according to claim 12, wherein said third transmission line element facilitates a desired characteristic impedance of said first and second transmission line elements while maintaining at least a minimum predetermined line width of said first and second transmission line elements.

16. The radio frequency directional coupler according to claim 12, wherein said third transmission line element reduces a coupling between the first and second transmission line elements.

17. The radio frequency directional coupler according to claim 12, wherein a thickness of said first and second transmission line elements is greater as compared to a thickness of said third transmission line element.

18. The radio frequency directional coupler according to claim 12, further comprising one or more discrete reactive elements coupled to said first and second transmission line elements.

19. The radio frequency directional coupler according to claim 12, further comprising one or more discrete reactive elements coupled to said third transmission line element.

* * * * *